United States Patent [19]

Mabrouk

[11] 4,140,056

[45] Feb. 20, 1979

[54] INK AND MOISTURE CONTROL SYSTEM WITH INK/MOISTURE INTERFACE

[75] Inventor: Saied A. Mabrouk, Macedonia, Ohio

[73] Assignee: Addressograph-Multigraph Corporation, Los Angeles, Calif.

[21] Appl. No.: 820,821

[22] Filed: Aug. 1, 1977

[51] Int. Cl.[2] ..... B41F 7/00; B41L 17/00; B41F 7/36; B41F 7/24

[52] U.S. Cl. ..... 101/148; 101/350

[58] Field of Search ..... 101/147, 148, 350

[56] References Cited

U.S. PATENT DOCUMENTS

| | | | |
|---|---|---|---|
| 2,969,016 | 1/1961 | Crosfield et al. | 101/350 |
| 3,412,677 | 11/1968 | Kantor | 101/148 |
| 3,442,121 | 5/1969 | Wirz | 101/148 |
| 3,916,789 | 11/1975 | Watts et al. | 101/148 |
| 4,052,937 | 10/1977 | Lawson et al. | 101/147 |

OTHER PUBLICATIONS

British Printer,: Apr. 1976; pp. 24 & 25; Is there An Ink/Water Balance.

*Primary Examiner*—Clyde I. Coughenour
*Attorney, Agent, or Firm*—George Jameson; Russell L. Root; Harry M. Fleck, Jr.

[57] ABSTRACT

A lithographic ink and moisture control system is provided for maintaining copy quality over a wide range of operating and environmental conditions without special operator assistance. The control system, among other things, momentarily increases the moisture feed rate each time ink is added to the system to maintain a substantially constant ink/moisture balance at the master, particularly under high coverage conditions.

4 Claims, 9 Drawing Figures

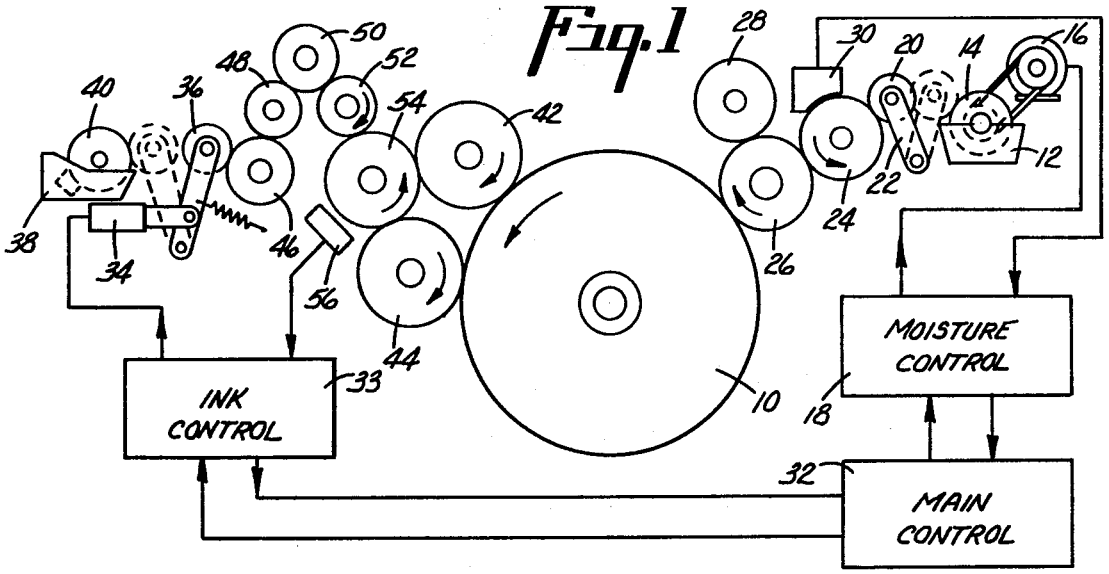
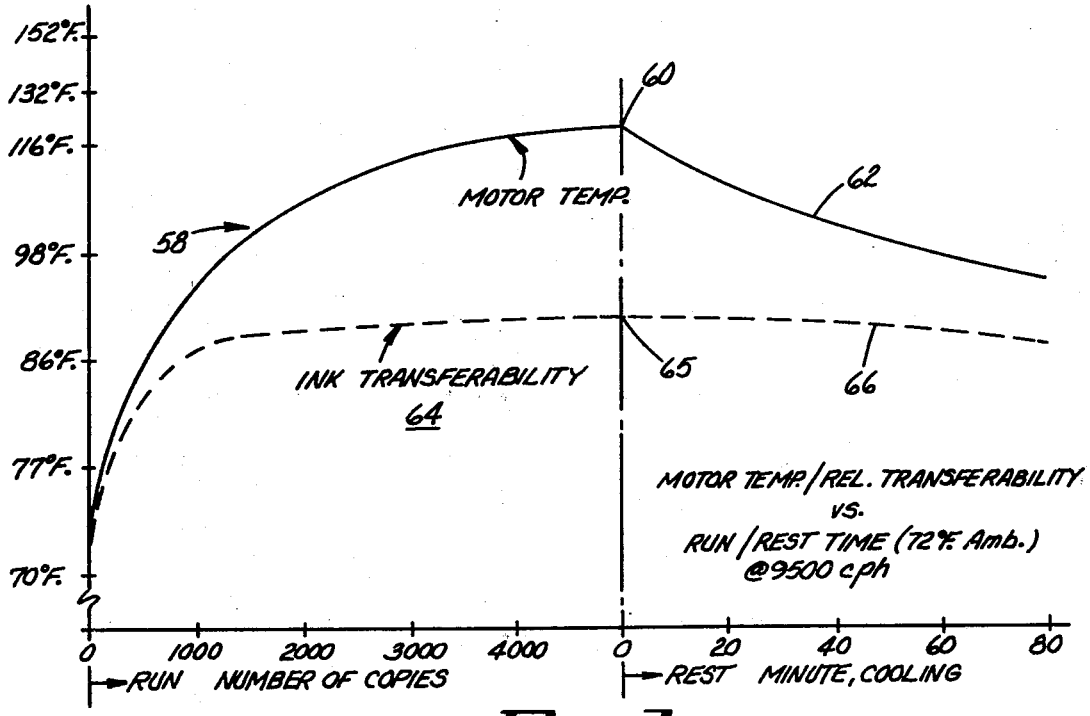
Fig. 2

INK AND MOISTURE CONTROL SYSTEM WITH INK/MOISTURE INTERFACE

BACKGROUND OF THE INVENTION

The present invention is generally related to lithographic duplicators and, more particularly, to a versatile system for controlling ink and moisture feed rates during printing.

The production of quality copies by lithographic means requires that the ink and moisture each be supplied at a rate proper for the demands of the lithographic master. It is also necessary that a proper balance be maintained between the ink and moisture at all times. If the amount of ink or moisture, or the balance therebetween, is not maintained within predetermined ranges, noticeable copy degradation will result. For example, excessive moisture or an excessive moisture/ink ratio will reduce the ink transferred, resulting in copies with low optical density image areas. On the other hand, low moisture or excessive ink will cause the image areas to be blurred and may result in background toning.

In general terms, one of the primary problems over the years has been that the ink and moisture requirements for producing quality copies vary significantly with changes in operating and environmental conditions. For example, variations in temperature and humidity will change the amount of moisture required by the master for quality copies. Also, certain plates or masters, both referred to herein generally as "masters" such as those of the zinc oxide type, undergo changes during copy runs which have an effect upon the amount of moisture required. The moisture/ink requirements also may be affected by the presence of additional moisture introduced into the system as new masters are loaded in sequence for relatively short copy runs, wherein each new master is "wet" and adds moisture to the system.

One of the major problems of lithographic duplication has been to maintain proper ink/moisture balance during copy runs. Various controls and systems have been proposed or manufactured which have in some way monitored the ink and/or moisture conditions and provided means for adjusting the respective feed rates. Such controls have provided satisfactory results under many operating conditions, yet under some conditions, for one reason or another, have not maintained the ink/moisture balance within acceptable limits. This deficiency of conventional systems may be attributed at least in part to the fact that the ink and moisture controls were operated independently of each other while, in fact, the two conditions are closely interrelated as the ink and moisture become mixed or emulsified by way of the master cylinder. Thus, in order to provide improved ink/moisture balance for a very wide range of operating conditions, the interrelationship between the two systems should be taken into account. It would be desireable to have a control which supplies ink and moisture in a manner which recognizes this interrelationship and provides appropriate interface between the ink and moisture control circuits.

Therefore, it is an object of the present invention to provide a novel control system for a lithographic duplicator with means for interfacing the ink and moisture feed controls to provide improved ink/moisture balance over a wide range of operating conditions.

It is another object of the present invention to provide a unique ink/moisture control system with interfaced circuit means which effects changes in the moisture feed rate in response to corresponding changes in the ink feed rate to provide improved ink/moisture balance.

It is a further object of the present invention to provide a novel ink and moisture control system with interface circuit means which momentarily increases the moisture feed rate in response to the addition of ink to the duplicator system, whereby the proper ink/moisture balance is maintained particularly under high coverage conditions.

Still another object of the present invention is to provide a versatile control system which is responsive to various operating and environmental conditions to control the ink and moisture feed rates, and which includes means for interfacing the ink and moisture controls.

SUMMARY OF THE INVENTION

The foregoing and other objectives are achieved in accordance with the present invention by utilizing the control signals to the ink supply means to effect corresponding changes in the moisture feed rate. The ink control circuitry associated with the present invention responds to various input signals associated with the operating and environmental conditions and provides ink feed rate control signals in response to the input signals. In the preferred embodiment, the ink feed rate control signals effect operation of the ink ductor by way of a solenoid or the like. Each time the ink ductor is operated, the interface circuitry associated with the present invention causes the moisture control circuit to momentarily increase the moisture feed rate, thereby adding additional moisture to the duplicator system. This helps to maintain the ink/moisture balance, particularly when running high coverage masters.

The control circuitry is also provided with feed-back signals from the ink and moisture supply rolls. These signals are utilized to adjust the respective feed rates to maintain such at the proper levels for the existing conditions.

BRIEF DESCRIPTION OF THE DRAWINGS

FIG. 1 is a diagrammatic illustration of the ink/moisture control system of the present invention.

FIG. 2 is a graphical representation of motor temperature and relative ink transferability v. the run/rest time of the duplicator.

Figure 3:
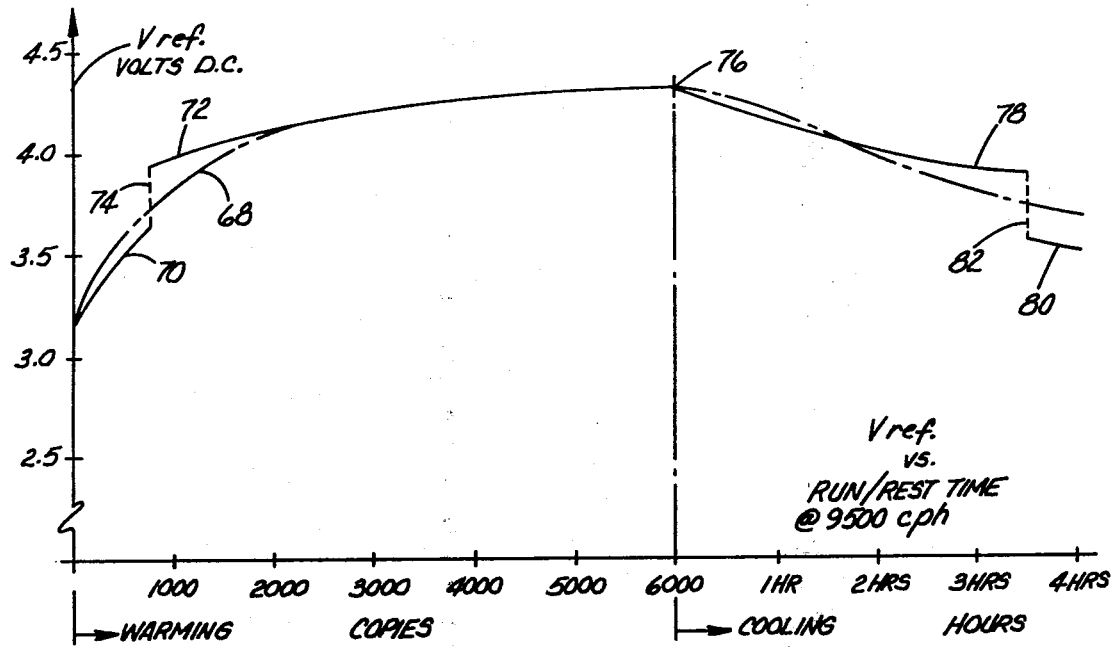
FIG. 3 is a graphical representation of changes in $V_{ref}$ of the control circuit v. run/rest time of the duplicator.

FIGS. *7a, 7b, 7c* are schematic diagrams of the circuitry associated with the control system of the present invention.

DESCRIPTION OF THE PREFERRED EMBODIMENT

Referring now, more particularly, to FIG. 1 of the drawings, the control system of the present invention is illustrated in diagrammatic form together with a master cylinder 10 of a lithographic duplicator. A master (not illustrated) is mounted on cylinder 10 for producing copies by well known lithographic processes. A suitable wetting solution, commonly referred to in the art as "moisture", is delivered to the master cylinder from a moisture fountain 12, provided with a fountain roll 14 having a hydrophilic surface. An appropriate fountain drive motor 16 rotates fountain roll 14 at a speed determined by signals from a moisture control 18.

A ductor roll 20 is rotatably mounted to an oscillating arm 22 for movement by a conventional mechanism between fountain roll 14 and a moisture transfer roll 24 having a hydrophylic surface. The transfer roll is in contact with a moisture form roll 26 having an oleophilic surface and which runs in contact with the master on cylinder 10. Preferably, a reciprocating distributor roll 28 is provided, which also has an oleophilic surface, and rides in contact with form roll 26. Reciprocation is achieved by a conventional internal cam mechanism, not illustrated, which effects axial shifting of the distribution roll to level the ink and moisture present on the surface of roll 26. A more detailed description of the moisture rolls and their operation appears in U.S. Pat. No. 4,029,008, issued June 14, 1977, for Moisture Control System, in the name of S. A. Mabrouk and assigned to the assignee of the present invention.

The system is provided with a speed sensor 30 which provides input signals to the moisture control indicative of the rotational speed of transfer roll 24 which, in turn, is indicative of the amount of moisture on the roll. Generally, this is an inverse relationship, but not necessarily linear. In the preferred embodiment, sensor 30 comprises a switch operated upon each revolution of the transfer roll to provide a pulse to the moisture control circuit. Alternately, other types of sensors may be utilized to produce the input signals. If desired, the transfer roll 24 may be mounted for axial oscillation, whereby each oscillation is sensed by a micro switch. Such an arrangement is described in the above listed U.S. Patent.

The moisture feed rate control signals to fountain motor 16 are provided by moisture control 18 in accordance with the input signals from sensor 30 and additional signals provided from a main control circuit 32. A detailed description of the main control circuit and the conditions to which it responds are described hereinafter.

The system is also provided with an ink control 33 which provides ink feed rate control signals to an ink supply means, including a ductor solenoid 34 which causes oscillation of a ductor roll 36. The ink is furnished to the system from a fountain 38 including a fountain roll 40 driven at a predetermined speed by an appropriate motive means, not illustrated. A pair of ink form rolls 42 and 44 serve to deliver ink to the master carried on cylinder 10. Ink is delivered to form rolls 42 and 44 by a series of ink transfer rolls 46, 48, 50, 52 and 54. Preferably, transfer roll 54 oscillates or reciprocates axially during rotation to provide a more uniform distribution of the ink to the form rolls. This reciprocal motion may be achieved by well-known cam mechanism or other appropriate means. The surfaces of the transfer and form rolls are ink receptive and, preferably, are of rubber or other elastomeric materials. The geometry and number of rolls illustrated is simplified for the purposes of the description. In actual practice it may be desirable to have more rolls and arrange such in a different geometry.

The control system includes an optical sensor 56 which furnishes signals to ink control 33 indicative of the ink film thickness at the nip of rolls 52 and 54. The optical sensor detects changes in the surface characteristics of the ink on roll 54, which characteristics are indicative of the thickness of the ink. Such a senser is disclosed in a copending U.S. patent application Ser. No. 709,666 for Ink Thickness Control and Method, assigned to the assignee of the present invention. If the ink film thickness increases beyond some predetermined value, determined in part by signals from main control 32, ink control 33 is effective to decrease the ductor oscillation rate and thus decrease the rate at which ink is added to the system. On the other hand, should the ink film thickness fall below some predetermined minimum value, the controls will increase the ductor oscillation rate to increase the ink film thickness to an acceptable level.

It will be appreciated that the thickness of the ink film on roll 54 is indicative of the rate at which ink is being used by the master. Since signals from the sensor 56 are related to the ink film thickness, changes in such signals are also indicative of the changes in the rate at which ink is used by the master. In the preferred embodiment, this is generally an inverse relationship, but not necessarily linear.

Referring to the graphic illustration in FIG. 2, the general relationships of motor temperature and relative ink transferability to operation of the duplicator may be understood. Two curves are illustrated, namely motor temperature and relative ink transferability. The vertical axis is representative of sensed motor temperature for one curve and relative transferability for the other curve. The horizontal axis generally represents the run/rest time of the duplicator for both curves and is expressed in terms of the number of copies and cooling or rest time in minutes. The motor temperature curve, generally indicated by numeral 58, is the result of data obtained from actual test measurements made while a lithographic duplicator was operated at a speed of 9500 copies per hour (cph) and at an ambient temperature of approximately 72° F. Changes in the temperature of the main motor were sensed through a thermistor embedded in the motor housing. The resultant curve rises most rapidly at the beginning of the copy run and increases at a lesser slope as the number of copies increases. When a duplicator is shut down after approximately 5000 copies, at a point indicated at 60, the motor temperature follows a cooling curve indicated by numeral 62 which slowly decreases toward room temperature. If the duplicator is left idle for a long period, say 6–10 hours, the motor temperature will approach or reach room temperature. For the purposes of this description, the cooling curve in FIG. 2 is not illustrated beyond 80 minutes.

It was observed that the transferability characteristics of pseudo-plastic lithographic inks change significantly during initial operation of the duplicator after shutdown for a relatively long period. It is during this stage of operation that it has been most difficult to obtain proper ink/moisture balance with conventional controls. Thus, it was necessary to make "dry runs", during which the operator set up or conditioned the ink and moisture levels. In FIG. 2, the ink transferability curve indicated by numeral 64 is generally representative of changes in relative ink transferability as a function of the ink's work/rest history. This curve is not the result of actual test measurements, but rather is an approximation based upon observations in copy quality and corresponding adjustments in the ink and moisture feed rates necessary to maintain acceptable copy quality. The curve is illustrated for the purposes of understanding the operation of the control of the present invention.

It was observed that when the duplicator was started up "cold" after a long shutdown, say overnight (as is quite common), the copy quality was unsatisfactory in spite of the fact that several conditions explained hereinafter were being monitored by the control, absent the ink transferability compensation circuitry. One of the several conditions monitored included ink temperature, since such is a significant factor in ink viscosity and tack. Thus, temperature has a direct effect upon the ink's transferability characteristics. Curve 64 is intended to be generally representative of changes in transferability attributable to working of the ink rather than attributable directly to the temperature of the ink. Although it is recognized that the ink will heat up slightly due to working. The relative ink transferability characteristics are lowest at start up. After approximately 1,000 copies, the transferability improves significantly and approaches a maximum or steady state condition after approxmately 1,500 copies. If the duplicator is shut down, say after 5,000 copies as illustrated at 65, the relative transferability gradually decreases as shown by the portion of the curve indicated at 66.

In the tests conducted, the ink and moisture levels were adjusted until acceptable copies were obtained, and corresponding curves were generated empirically which approximate necessary changes in the ink and moisture feed levels to compensate for changes in ink transferability due to working. It will be appreciated that the relative ink transferability curve 64 generally parallels the sensed motor temperature curve 58 within limits, at least during the initial 1,000 copies and again after the duplicator has been shut down for an hour or so. The control circuitry described hereinafter includes means for adjusting the ink and moisture feed rates to compensate for predicted changes in relative ink transferability in accordance with the ink's work/rest history within predetermined time intervals. This is achieved by monitoring the motor temperature and utilizing such as an input to the control circuitry. The input signals are tailored by the circuitry to provide a variable reference signal $V_{ref}$, which approximates the ideal control signal for adjusting the feed rates to maintain acceptable copy quality.

The ideal and actual control signal curves are illustrated in FIG. 3. The ideal curve is illustrated in broken line and is indicated by numeral 68. It will be appreciated that this curve represents the signal equivalent to the relative transferability curve 64 of FIG. 2. For the sake of simplicity and reduced manufacturing cost, it has been found desirable to provide circuitry, hereinafter described, which approximates the ideal curve 68 by providing a control signal $V_{ref}$ which follows a pair of curves 70 and 72 during warm up of the duplicator with a transition at 74. After shut down, which is indicated at numeral 76, $V_{ref}$ follows curve 78 for several hours of cooling down and is shifted to curve 80 through transition 82. As hereinafter explained, the $V_{ref}$ signals are utilized by the control to effect adjustment of the ink and moisture feed rates to compensate for predicted changes in ink transferability due to the ink's work/rest history.

In addition to compensating for changes in ink transferability, the control adjusts the ink and moisture feed rates to accomodate predicted changes in master conditions. Many masters of the type having "paper" bases tend to become moisture laden during the course of a copy run. The amount of moisture required by such masters decreases somewhat during the run. The exact reasons for this change in moisture demand are not known. However, it is believed that moisture is picked up by the master by absorption, or otherwise, as copies are run and, as such, it is necessary to provide more moisture early in the copy run and taper the moisture off until the occurrence of what is believed to be a saturation condition.

The control of the present invention is provided with a taper compensation circuit which offsets this adverse effect. Curves 84 and 86 are representative of the ink and moisture and feed rate changes which are effected by the taper compensation circuit to maintain proper ink/moisture balance. This circuitry, which is hereinafter described in detail, is tailored to provide control signals to offset predicted adverse conditions encountered with use of a particular type of master. The illustrated curves and the circuitry disclosed herein are the results of data compiled from test runs utilizing ZnO type masters which are sold under the Addressograph Multigraph trademark and identified as type 8-2004. It will be appreciated that the moisture feed rate is gradually decreased while the ink feed rate is increased gradually during the copy run until steady state rates are reached after approximately 1,000 copies. Of course, it is not intended that the present invention be limited to a particular type of master or to the curve illustrated in FIG. 4, as the compensation circuit and associated parameters may be selected to accomodate various types of masters and conditions.

It has been observed that when a lithographic duplicator is shut down momentarily, some of the moisture introduced into the system evaporates to the surrounding atmosphere. This causes a momentary moisture imbalance condition upon restart which adversely affects copy quality. The amount of moisture lost during shutdown depends to a large extent upon the duration of the shutdown, although other factors, such as humidity and temperature also affect the evaporation rate. In order to eliminate the need for operator assistance to obtain the proper balance after such shutdowns, the control of the present invention is provided an evaporation compensation circuit which offsets to a large degree the moisture imbalance normally experienced upon restart. The degree to which the compensation circuit increases the moisture feed rate is related to the duration of the shutdown time within limits. The addition of large amounts of moisture results in erroneous signals from the ink sensor due to a film of water on the ink sensor roll. The circuitry is effective to compensate for this condition and the fact that the ink is drier and more transferable until the predicted imbalance condition has been fully corrected. Since evaporation is not significant when the machine is cold (i.e., below 82° F. motor temperature), the evaporation condensation circuit as in effect inhibited below a predetermined threshhold motor temperature and does not influence in the ink or moisture feed rates.

Figure 5:
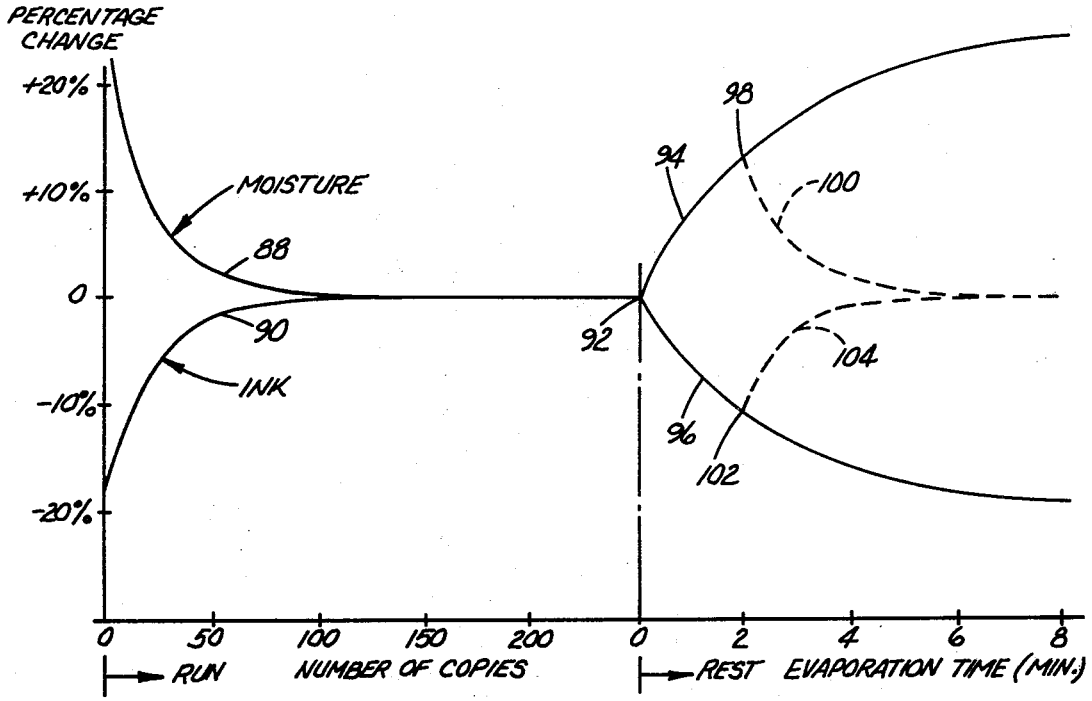
FIG. 5 is a graphical representation of changes in the ink and moisture feed rate v. run/rest time.

Referring to FIG. 5, operation of the moisture evaporation compensation circuit may be generally understood. The percentage change in moisture feed rate is illustrated by curve 88 in FIG. 5. The circuitry also causes a corresponding decrease in the ink feed rate, as illustrated by curve 90 to compensate for transient conditions at the ink sensor and for the fact that the drier ink is more transferable, requiring lesser ink. These curves and the parameters for the associated circuitry were arrived at empirically as the result of data compiled utilizing type 8-2004 masters.

It will be observed from the curve that under the worst evaporation conditions, normal ink and moisture feed rates are restored within approximately 120 copies after start up. Shut down of the duplicator is indicated at 92. Curves 94 and 96 indicate the initial moisture compensation provided by the circuitry depending upon the rest or evaporation time. For example, if the duplicator were shut down for 2 minutes, the circuitry would increase the moisture feed rate approximately 12% as indicated at point 98 and follow dash line curve 100. Similarly, the ink feed rate would be reduced approximately 10% as indicated at point 102 and would follow dash line curve 104.

Figure 6:
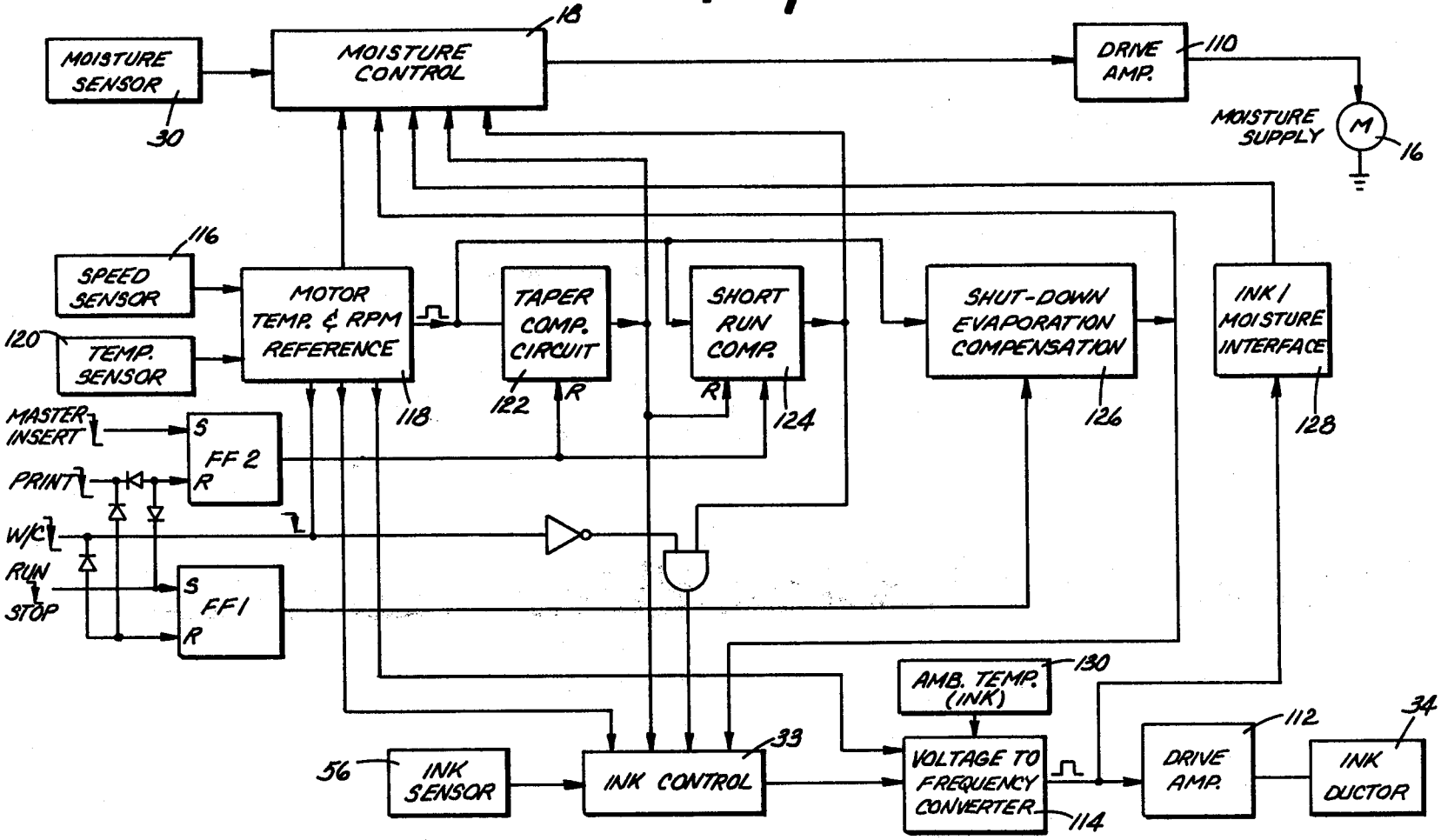
FIG. 6 is a block diagram of the ink/moisture control system of the present invention.
Figure 6A:
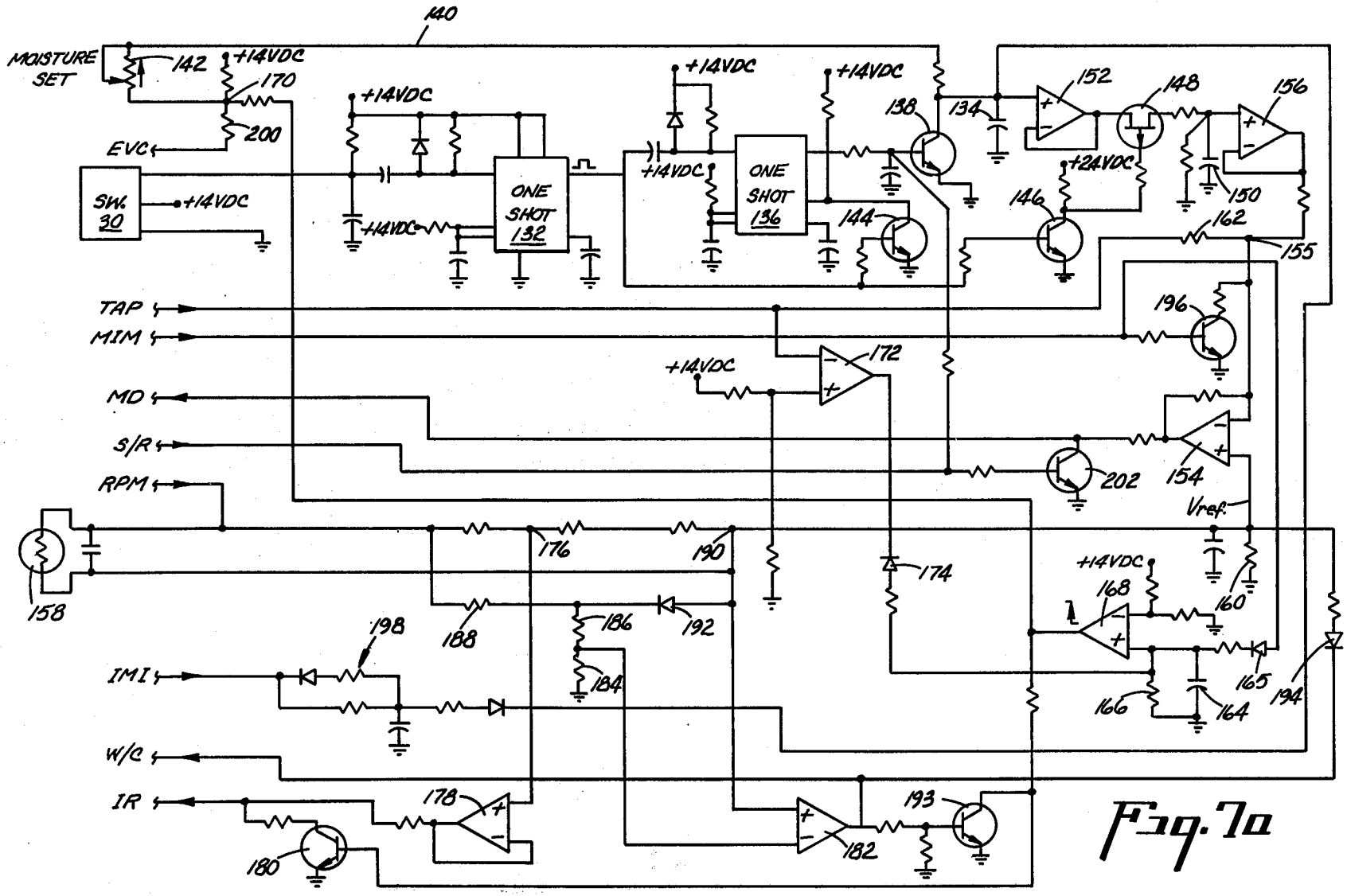
Figure 6B:
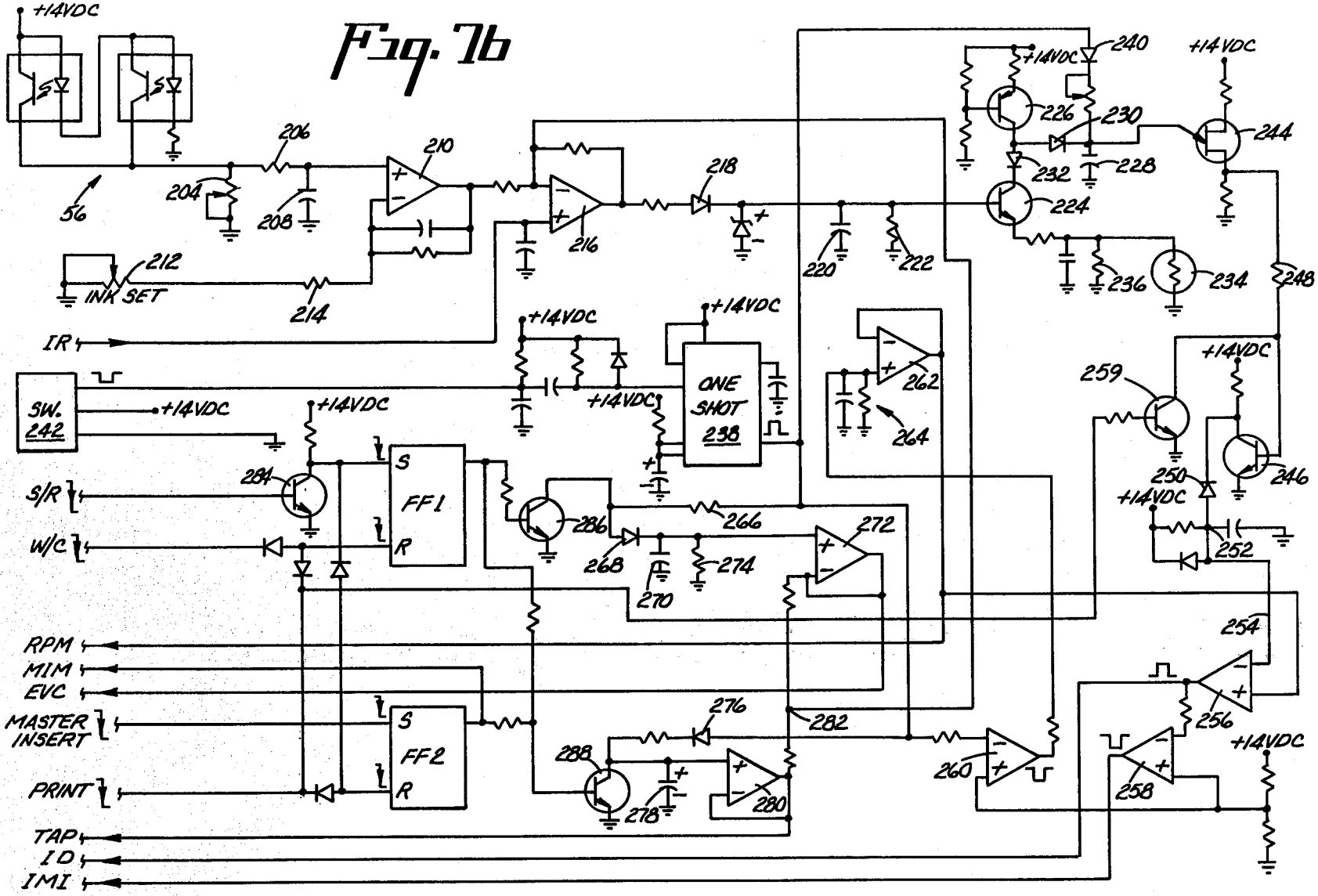

Referring now, more particularly, to FIG. 6 of the drawings, operation of the control system and the circuitry thereof may be more fully understood. As explained above, the moisture control circuit serves to provide moisture feed rate signals to the moisture fountain motor 16. This is achieved through an appropriate drive amplifier circuit 110 and in response to signals received from moisture sensor 30 and from various other control circuits described herein. The ink control 33 also responds to input signals from the various control circuits and to the signals received from ink sensor 56. The ink ductor solenoid 34 is controlled by a drive amplifier 112 which receives control pulses from a voltage-to-frequency converter 114.

Since both the ink and moisture requirements of the duplicator are dependent upon the speed at which the duplicator is operated, signals indicative of the machine speed are provided by an appropriate speed sensor 116. These signals are fed to a Motor Temperature and RPM Reference circuit 118 and have the influence of increasing the ink and moisture feed rates with an increase in machine speed. Input signals are also provided to circuit 118 from temperature sensor 120, which signals are indicative of an operating temperature of the machine and reflect changes in ink transferability due to working of the lithographic ink.

Figure 4:
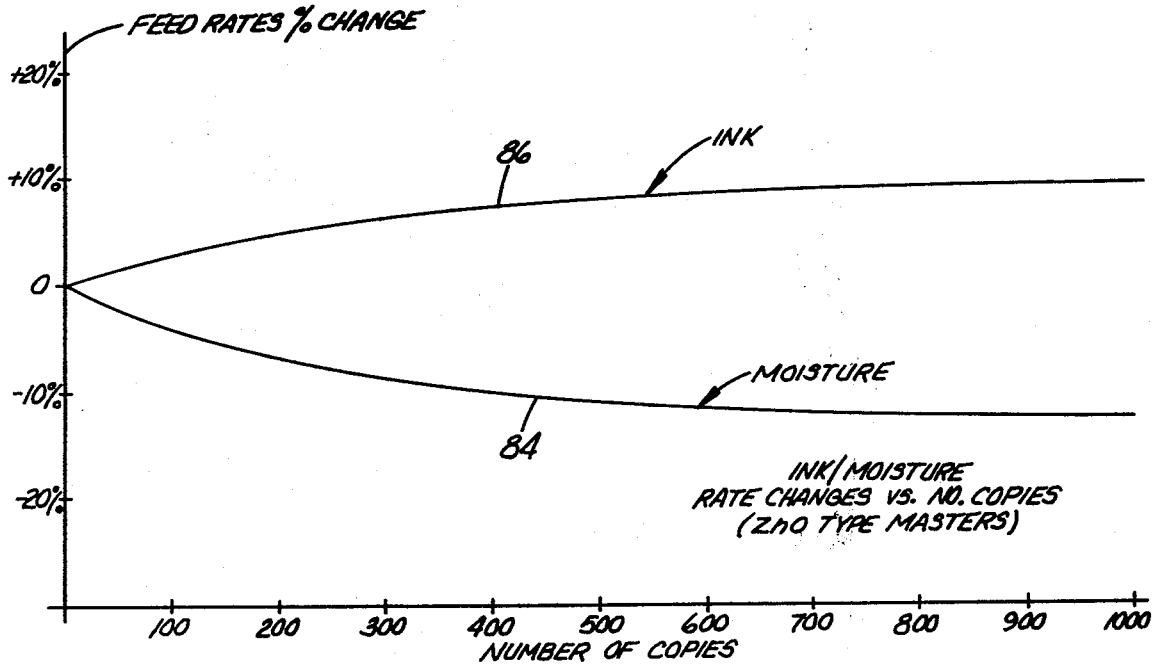
FIG. 4 is a graphical representation of changes in the ink and moisture feed rates v. number of copies.

A taper compensation circuit 122 is provided for altering the ink and moisture levels in anticipation of predictable changes in master conditions during a run. After a new master has been inserted at the beginning of a run, signals from compensation circuit 122 serve to gradually decrease the moisture reference level while increasing the ink reference level. As illustrated in FIG. 4, as the number of copies increases in a run, the rate of change of the taper compensation signal decreases. It will be appreciated that the circuitry is tailored to match the type of master and ink being utilized, and the circuit values may be determined empirically by observing copy quality produced under various ink/moisture feed rate conditions.

A short-run compensation circuit 124 is provided for reducing the amount of moisture added to the system in the event of multiple short-runs. It has been found that several consecutive short-runs produces excessive moisture in the system, part of which is introduced with each newly inserted master carrying considerable conversion solution. The short-run compensation circuit in effect keeps track of the length of each run and reduces the moisture reference level under predetermined multiple short-run conditions. This circuit also is effective to increase the ink level under multiple short-run conditions when the machine is below a predetermined operating temperature. Preferably, the effects of this circuit are inhibited by the occurrence of a long copy run which would use up the excess moisture and allow the system to reach a steady state condition.

An evaporation compensation circuit 126 is provided for adjusting the ink and moisture reference levels based upon predicted evaporation of moisture from the machine during short shut-downs. The circuit is effective only when the machine is operating above a predetermined temperature indicative of warm operating conditions. Under such conditions, when the machine is not running, moisture evaporate from the ink/moisture emulsion and the various machine components. This results in a more or less "dry" layer of ink on the ink sensing roll. When a new master is introduced, moisture brought with it tends to lie on top of the ink which has dried on the ink sensing roll. This produces erroneous ink demand condition signals due to the higher than normal reflectivity of the surface moisture detected by the optical sensor. Signals from the compensation circuit 126 are effective to decrease the ink reference level during this transient period. Also, since various rolls and other system components have dried during the shut-down period, signals from this circuit cause a change in the moisture reference level to increase the moisture feed rate.

It has been found that the moisture feed back signals from the transfer roll sensor are not adequate for maintaining proper balance when running high coverage masters. since such masters require a large amount of ink, the system must respond with a corresponding amount of moisture in order to maintain proper balance at the point of printing. The moisture sensing roll is spaced from the printing location and, as such, the resultant signals only approximate the actual moisture conditions existing at the printing location. When running masters of average coverage, the moisture gradient between the sensing and printing locations is relatively low, such that the feed back signals closely approximate the actual conditions at the master and adjustments in the moisture feed rate are effective to maintain balance within acceptable limits. However, when running high coverage masters, the moisture demand is much higher, creating a large moisture gradient between the sensing and printing locations. Thus, the moisture feed back signals do not closely approximate the actual moisture conditions at the master. This results in supplying less moisture than the master actually requires.

In order to correct for this deficiency, the control system of the present invention is provided with means for automatically increasing the moisture feed rate to a greater extent than indicated by the moisture feed back signals under high coverage conditions. This is achieved by way of an ink/moisture interface circuit 128, which receives pulses from voltage-to-frequency convertor 114 and effects momentary increase in the moisture feed rate through moisture control 18.

When running high coverage masters, the ink feed back circuitry responds to provide a corresponding ink ductor rate. Thus, the ink ductor rate is generally indicative of the coverage requirements of the master. The control of the present invention utilizes this factor to effect a momentary increase in the moisture feed rate each time the ink ductor is pulsed. Since the ductor is pulsed at a greater rate as the master coverage is increased, the amount of moisture added to the system is correspondingly increased to help maintain proper ink/moisture balance.

At ink ambient temperature circuit 130 is provided for furnishing signals to Voltage-to-Frequency Converter 114 which are indicative of the temperature sensed in the vicinity of the ink rolls. These signals are generally representative of the temperature of the ink present on the ink supply rolls. This has been found to be necessary since the ink transferability is dependent to a significant extent upon the temperature of the ink. A pair of flip flops FF1 and FF2 are shown in the block diagram of FIG. 6 to provide logic control to reset or enable the various compensation circuits. The details of such operation and the circuitry are explained hereinafter.

MOISTURE CONTROL

Referring to FIG. *7a*, it will be appreciated that rotation of the moisture transfer roll 24 causes operation of switch 30, which produces a pulse for each revolution. This triggers a one-shot circuit 132, producing a pulse of predetermined duration, during which the voltage stored across a capacitor 134 is sampled. The output pulse of one-shot circuit 132 defines a sample period, at the end of which a second one-shot circuit 136 is fired to apply a pulse to the base of transistor 138, causing such to conduct and discharge capacitor 134. At the end of this discharge pulse, the transistor 48 is rendered non-conductive and capacitor 134 will begin recharging through line 140 connected to a voltage source through an adjustable resistor 142. The capacitor will continue to charge for the remainder of the revolution of transfer roll 24.

The output pulse of one-shot circuit 132 is applied to the base of transistor 144, the collector of which is connected to one-shot circuit 136. Transistor 144 is rendered conductive, which inhibits operation of the one-shot circuit 136 during the sample pulse from one-shot circuit 132. The sample pulse also renders transistor 146 conductive, which in turn causes a unijunction transistor 148 to conduct. During this time, the voltage previously built up on capacitor 134 is stored on capacitor 150 through an operational amplifier 152. The voltage stored on capacitor 150 is passed through amplifier 156 to a summing junction 155 where it is combined with the TAP level from the taper compensation circuit to provide a reference level to the negative input of a comparator 154.

COMPENSATION FOR WORK/REST HISTORY COMPONENT OF INK TRANSFERABILITY CONDITION

A combined speed and temperature reference level, denoted as $V_{ref}$ is applied to the positive input of comparater 154. Machine speed input signals, denoted as RPM, are provided from means hereinafter described. These signals are applied to a thermistor 158 which, preferably, is embedded in the motor winding or housing to sense changes in motor temperature during warm-up. It is possible that this thermistor, or an equivalent device, might be mounted at a different location within the duplicator and still provide signals which are indicative of the run-rest history of the machine and thus furnish useful data or information indicative of predicted changes in ink transferability due to working of the ink. As the motor temperature increases, the resistance of the thermistor decreases. The thermistor forms a voltage divider with registor 160, such that as the motor temperature increases, the $V_{ref}$ level impressed upon the positive input of amplifier 154 increases. This increases the motor drive level MD which increases the speed of the moisture fountain motor, thereby increasing the rate at which moisture is added to the system.

An ink reference level IR is obtained through amplifier 178, the positive input of which is connected to junction 176 and follows $V_{ref}$. When the machine is cold (i.e., below predetermined warm temperature) the level of IR is such that the ink control circuit responds to increase the ink supply rate. This has been found necessary in order to provide satisfactory copy quality during machine warm-up. It will be appreciated that after the duplicator is shut-down, the ink's transferability decreases with its rest time. The motor temperature sensed by the thermistor 158 is used to provide signals indicative of the rest time of the ink. Thus, when the machine is restarted, the level of $V_{ref}$, as determined by the thermistor, will appropriately adjust the ink and moisture levels to reflect predicted changes in ink transferability due to non-working of the ink during shut-down.

A WARM/COLD temperature circuit is comprised of a comparator 182, the negative input of which is connected to a voltage divider defined in part by resistors 184, 186 and 188. The positive input of comparator 182 is connected to junction 190 which is at the $V_{ref}$ level. The values of resistors 184, 186 and 188 are selected such that when the sensed temperature reaches a predetermined warm level, the output of comparator 182 goes high. As the motor temperature increases further, a clipping diode 192 conducts and clamps $V_{ref}$ and reduces the slope as illustrated in FIG. 3. This will cause an increase in the level of $V_{ref}$ due to diode 194 being rendered non-conductive.

TAPER COMPENSATION FOR MOISTURE

Input signals, denoted as TAP, received from the taper compensation circuit and are applied to the negative input of amplifier 154 through resistor 162 and junction 155. At the beginning of a run, the level of TAP is lowest and, since such is applied to the negative input of the amplifier 128, tends to increase the moisture feed rate. As the run continues, TAP decreases, causing a gradual decrease in the moisture feed rate.

RUN-LENGTH COMPENSATION

The multiple short-run compensation circuit includes a storage capacitor 164, which is partially charged by an input pulse MIM through diode 165 after each new master is inserted. The capacitor discharges slowly to ground through a resistor 166. The charge level on capacitor 164 is applied to the positive input of comparator 168, the output of which is fed to a summing junction 170. The time constant defined by capacitor 164 and resistor 166 is such that if a small number of copies is run per master (for example, 25 copies or less) the capacitor will be only partly discharge during that time. When the next master is inserted, the charge on capacitor 164 is increased slightly by another MIM pulse. This occurs for each new master inserted after a short run until the level impressed upon the positive input of the comparator 168 becomes greater than that applied to the negative input, in which event the output goes high. When this is applied to summing junction 170, such has the effect of decreasing the resultatnt moisture reference level and moisture feed rate.

As mentioned above, operation of the multiple short-run compensation circuit is inhibited upon occurrence of a long run, for example, after a predetermined number of copies has been made from a single master. This inhibit operation is achieved by monitoring the level of the taper compensation signals TAP which are applied to the negative input of comparator 172. The TAP level increases during each run on a new master and such reflects the number of copies which have been made with the master. When TAP reaches a level corresponding to the number of copies defined for a long run, the output of comparator 172 goes low. This causes diode 174 to conduct, thereby discharging the capacitor 164. Thus, any charge build-up on capacitor 164 due to prior short runs is removed upon the occurrence of a long copy run.

Ink reference level signals IR are provided from junction 176 through amplifier 178. It will be appreciated that this level is changed in response to a multiple short-run condition when the machine is cold. Under these conditions, the high output of amplifier 168 renders transistor 180 conductive to ground, thereby reducing the level of IR. When the machine is warm, the output of comparator 182 is high and renders transistor 193 conductive to ground. This inhibits operation of transistor 180 thereby inhibiting change in the IR level due to multiple short runs when the machine is warm.

Preferably, the duplicator includes means for inking and wetting each new master after such has been placed on the master cylinder. Each wetting cycle tends to introduce some moisture to the system in addition to the conversion solution on each master. After this has been completed, the ink blanket roll is inked for several cycles of the machine. This preprint sequence is executed each time a new master is introduced and is necessary in order to prepare the master and duplicator for proper printing. Such pre-print sequences are well-known and in many cases are performed automatically, as is the case with the duplicator of applicant's invention. A detailed description of the pre-print sequence and the associated circuitry and mechanism is felt to be unnecessary for the purposes of this disclosure. However, it should be noted that during the pre-print sequence, the MIM level goes high momentarily to effect charging of capacitor 164 associated with the multi short-run compensation circuit. In addition, transistor 196 conducts to ground thereby decreasing the signal to the negative input of amplifier 154. This increases the moisture feed rate.

INK-MOISTURE INTERFACE

As mentioned above, the ink/moisture interface circuit is effective to increase the moisture supply rate when the ink ductor solenoid is pulsed. Upon each operation of the ductor solenoid, ink/moisture interface signals IMI are fed to an invertor and pulse stretcher generally indicated by the numeral 198. This produces negative pulses of longer duration which are fed to the positive input of amplifier 152 and changes the resultant moisture reference level in a manner which causes the moisture fountain motor to be driven faster during the pulse.

EVAPORATION COMPENSATION FOR MOISTURE

Figure 7:
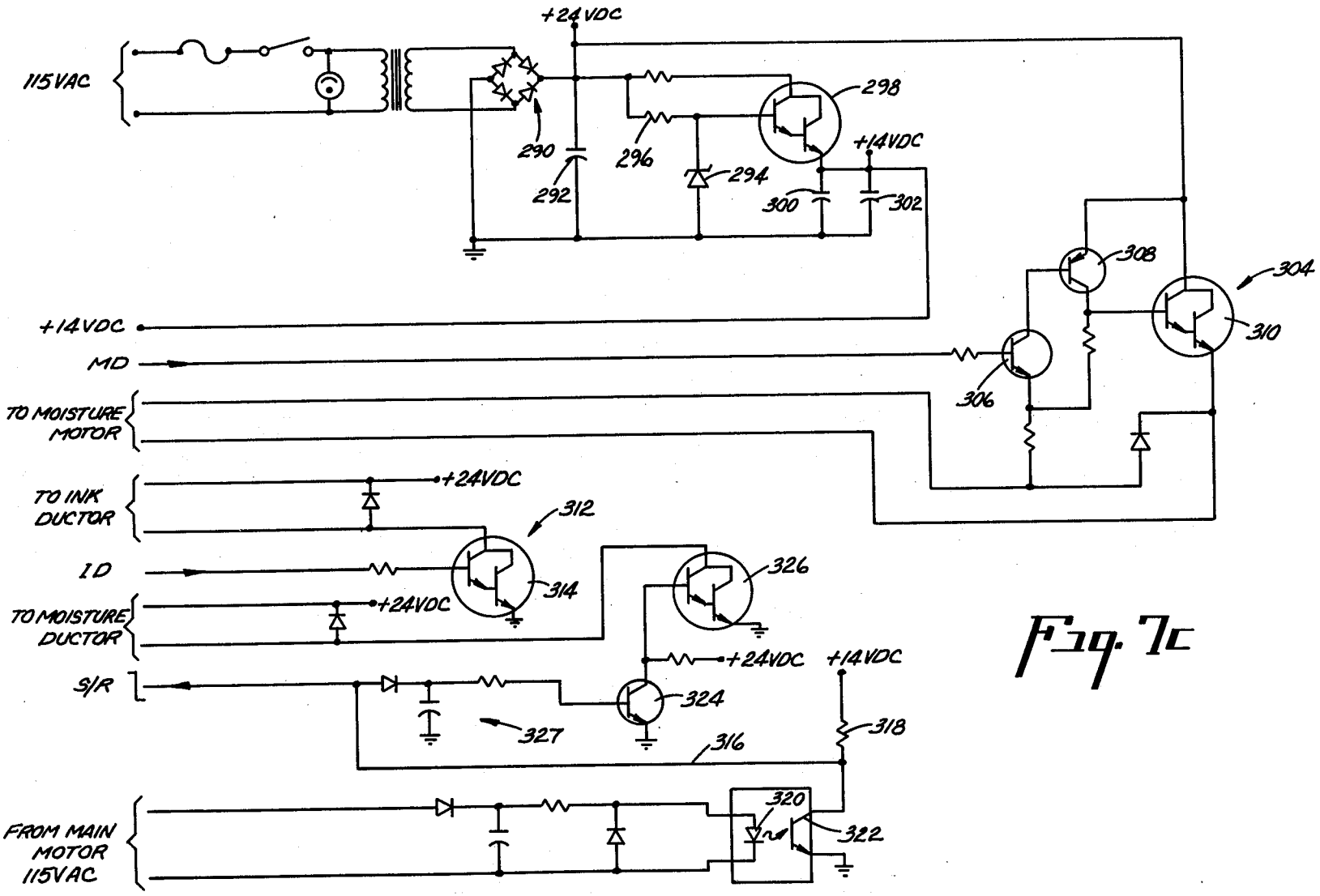

Evaporation compensation signals EVC are provided by the circuitry illustrated in FIG. 7*b* and are impressed upon junction 170 through resistor 200. At the beginning of a new run when the machine is warm, the level of EVC will tend to increase the moisture feed rate to compensate for moisture which has evaporated during shutdown.

It will be appreciated that the moisture control circuit is disabled when the machine motor is shut down. This is achieved in response to stop/run signal S/R which goes high when the motor is shut down. This causes transistor 202 to conduct to ground, thereby inhibiting passage of the motor drive signals MD. The S/R level is also applied to the base of transistor 138, causing such to conduct to ground to discharge storage capacitor 134 in preparation for recharging when the machine is restarted.

INK CONTROL

Referring now, more particularly to FIG. 7*b*, operation of the ink control and associated components may be more fully understood. Preferably, the ink sensor is comprised of a pair of optical detectors, generally indicated by the numeral 56, which receive radiation reflected from the ink surface on sensing roll 54. Generally, these signals are inversely related to the ink film thickness. A more detailed description of the optical sensor arrangement is disclosed in co-pending application, Ser. No. 709,666, incorporated herein by reference. The sensitivity setting of the optical sensor may be adjusted by way of a potentiometer 204. A resistor 206, together with a capacitor 208, define an RC filter which passes signals from the optical sensor to the positive input of an operational amplifier 210. An ink level potentiometer 212 is connected to the negative input of amplifier 210 through a resistor 214. In effect, the setting of potentiometer 212 determines the gain of amplifier 210.

A comparator 216 compares the output of amplifier 210 with the ink reference level IR. As mentioned above relative to FIG. 6, the IR level follows $V_{ref}$ and is indicative of the sensed motor temperature, and thus, the run/rest history of the duplicator within predetermined limits. When the duplicator is cold, such as occurs with a morning start-up, IR is relatively low and tends to drive the output of comparator 216 low. The actual output of the comparator of course, also depends upon the optical sensor signals furnished through amplifier 210. When the output of comparator 216 is high, such is indicative of a condition requiring a faster ink feed rate. The output of capacitor 216 is passed by diode 218 to an RC delay circuit defined by capacitor 220 and resistor 222. The delayed signals are applied to the base of a transistor 224 associated with the voltage-to-frequency converter. A transistor 226 provides a charging current to capacitor 228 through a diode 230. When transistor 224 is conductive, at least part of the current from transistor 226 passes to the collector of transitor 224 through diode 232. Thus, transistor 224 controls the charging rate of capacitor 228, bypassing a portion of the charging current to ground through a thermistor 234 and resistor 236.

Thermistor 234 is mounted in the duplicator at a location in the vicinity of the ink carrying rolls and, as such, its resistance is indicative generally of the temperature of the ink on the rolls. The indication given by this thermistor is representative of a temperature value referred to herein as the "ink ambient temperature" which is close enough to serve as a practical measure of the temperature of the ink on the rolls. It has been found that this enhances the operation of the control considerably since the transferability of the ink is dependent to a significant extent upon ink temperature, as well as working. When the sensed ink ambient temperature increases, the resistance value of thermistor 234 decreases, thereby causing more of the charging current to flow to ground, reducing the charge rate of capacitor 228 and decreasing the ink feed rate. Charging current is also provided by a oneshot circuit 238 which produces positive pulses of predetermined width to capacitor 228 through a diode 240. Each master cylinder revolution, switch 242 produces a negative going pulse which is differentiated by circuit 243 and triggers one-shot 238.

When capacitor 228 reaches a predetermined charge level, a uni-junction transistor 244 generates a trigger pulse which is applied to the base of transistor 246 through resistor 248. The trigger pulse renders transistor 246 conductive. This produces an inverted pulse at the collector of transistor 246 causing diode 250 to conduct. This pulls junction 252 low, together with line 254 connected to the negative input of comparator 256. The RPM reference level is applied to the positive input of comparator 256 and is inversely related to the machine speed, as hereinafter described.

When the charge on capacitor 228 reaches the level necessary to fire uni-junction transistor 244, such is indicative of a condition requiring the addition of ink to the system. In most cases this will be the result of signals from the ink sensor. However, when running very low coverage masters, charging of the capacitor 228 will be caused solely by pulses from one-shot 238. This assures that ink is always added to the system after a predetermined number of copies (say 50 copies) has been run. It has been found that this aids in maintaining the ink-/moisture balance under low coverage conditions. This results in a negative going pulse applied to the negative input of comparator 256, producing a positive output pulse ID which is fed to the ink drive circuit for pulsing the ductor solenoid. A corresponding negative going pulse is provided at the output of amplifier 258 to define the ink/moisture interface signal IMI, which momentarily increases the moisture feed rate.

When the machine is not printing, the PRINT level is low. This causes transistor 259 to conduct to ground, thereby inhibiting operation of the ink ductor until the machine goes to the PRINT condition. The RPM reference signal is produced as a result of the output pulses from one-shot circuit 238. These pulses are inverted by amplifier 260, and applied to the positive input of amplifier 262 through RC integration circuit 264. The output of amplifier 262 defines the RPM reference level which is applied to the positive input of amplifier 256 and provided to the moisture control circuit shown in FIG. *7a*.

TAPER AND EVAPORATION COMPENSATION FOR INK

The output pulses from one-shot circuit 238 are also fed to the evaporation compensation circuit through resistor 266 and diode 268. These pulses incrementally charge capacitor 270, the level of which is applied to the positive input of amplifier 272. When the machine is shut off, capacitor 270 discharges slowly through a resistor 274. In the preferred embodiment the time constant is approximately five minutes. The discharge corresponds to the predicted moisture evaporation which occurs while the machine is shut down. Upon restart, the reduced charge level on capacitor 270 effects the corresponding level of evaporation compensation signal EVC. As mentioned above, the evaporation compensation circuit is effective only when the machine is warm, or in other words, when the W/C is high.

The taper compensation circuit which adjusts the feed rates for changes in master condition receives pulses from one-shot 238 through diode 276 which normally charges a capacitor 278. The charge level impressed upon the positive input of amplifier 280, the output of which provides the taper compensation signal TAP. This is applied to a summing junction 282 together with EVC from aplifier 272 and the result applied to the negative input of amplifier 216 to adjust the ink level accordingly.

When the machine is shut down, S/R goes high, causing transistor 284 to conduct, which set FF1 and resets FF2. After the machine is restarted and a new master is inserted, the output of FF1 remains high and FF2 goes high. This renders transistors 286 and 288 conductive during the inking and wetting pre-print cycles. Under these conditions, the previous charge on capacitor 270 is retained, while any charge present on capacitor 278 is removed. However, if the machine is cold, W/C will reset FF1 during the pre-print cycles. This renders transistor 286 non-conductive and capacitor 270 is allowed to become fully charged during the pre-print sequence. This neutralizes the effect of the evaporation compensation circuit when printing is begun.

After the pre-print sequence is completed, and copying begun, the print signal goes low, resetting FF2 to render transistor and 288 non-conductive. FF1 is also reset if such has not already been done by W/C. At this point in time, if the machine is warm, the charge level remaining on capacitor 270 is indicative of the time interval during which the machine was shut down and representative of the moisture loss due to evaporation. As copies are run, the charge level on both capacitors is incrementally increased to gradually reduce the effects of both the taper and evaporation compensation circuits.

POWER SUPPLY

Referring to FIG. *7c*, the power supply associated with present invention may be understood. A full wave rectifier generally indicated by the numeral 290 provides 24VDC, which is applied across a filter capacitor 292. A Zener diode 294 is connected between ground and 24VDC through resistor 296. The Zener diode is also connected to the base of a power transistor 298, which together with capacitors 300 and 302 provide a regulated 14VDC source.

The moisture drive circuit, generally indicated by the numberal 304, receives MD signals which are applied to the base of transistor 306. These signals are amplified through transistor 308, which in turn drives power transistor 310 to furnish drive signals to the moisture fountain motor.

The ink drive circuit, generally indicated by the numeral 312, receives ID signals which are applied to the base of power transistor 314. When ID goes high, transistor 314 conducts to ground and energizes the ink ductor solenoid.

The stop/run signal S/R is provided by a 14VDC source connected to line 316 through resistor 318. When the machine is shut down and the main motor is not energized S/R is high. When the main motor is energized through appropriate switching means, not illustrated, a light emitting diode 320 causes this photo transistor 322 to conduct, which pulls line 316 and S/R low. Under these conditions, transistor 324 is rendered non-conductive, causing power transistor 326 to conduct to complete the circuit to the moisture ductor. An RC circuit 327 is provided which delays start of the moisture ducting operation. This allows wetting of the ductor which is held in contact with the fountain roll during shutdown. It will be appreciated that moisture ductor is provided with appropriate mechanism, not illustrated, which controls the ductor rate while the machine is running. When the main motor is de-energized, S/R goes high, causing transistor 324 to conduct, which turns off power transistor 326 to de-energize the moisture ductor circuit.

What is claimed is:

1. An ink and moisture control system for a lithographic duplicator for producing copies from a master, said control system comprising:

means for supplying moisture to the master in accordance with moisture feed rate control signals, means for supplying ink to the master in accordance with ink feed rate control signals, means for sensing moisture conditions to provide sensed moisture demand signals which are generally representative of the amount of moisture being used by the master, means for sensing ink conditions to provide sensed ink demand signals which are generally representative of the amount of ink being used by the master, ink control means responsive to said ink demand signals for providing said ink feed rate control signals to said ink supply means to control the rate at which ink is supplied, moisture control means responsive to said moisture demand signals for providing moisture feed rate control signals to said moisture supply means to control the rate at which moisture is supplied, and circuit means associated with said ink control means for furnishing compensation signals to said moisture control means in response to and in parallel with said ink feed rate control signals as the same are changed to increase or decrease ink feed, said moisture control means providing said moisture feed rate signals in accordance with said moisture demand signals and said compensation signals.

2. The control system as set forth in claim 1 wherein said moisture control means is responsive to said moisture demand signals which basically provide the primary basis for a moisture level reference signal determining the basic moisture supply rate and wherein said compensation signals cause corresponding changes in said reference level signal to effect the compensating changes in said moisture supply rate.

3. The control system set forth in claim 1 wherein said moisture sensing means senses said moisture demand conditions at a location spaced from the master.

4. The control system as set forth in claim 1 in which said ink control means furnishes signal pulses to said ink supply means, the frequency of said pulses varying directly in relation to the amount of ink to be supplied, and in which an increasing frequency of said pulses causes said circuit means to generate compensation signals calling for an increased level of moisture feed.

* * * * *

UNITED STATES PATENT AND TRADEMARK OFFICE

CERTIFICATE OF CORRECTION

PATENT NO. : 4,140,056

DATED : February 20, 1979

INVENTOR(S) : Saied A. Mabrouk

It is certified that error appears in the above-identified patent and that said Letters Patent are hereby corrected as shown below:

In the drawing, sheet 6, Fig. 7b, the reference numeral 243 should be applied to the capacitor positioned in the line extending between the switch 242 and the one shot 238. Column 6, line 56, "condensation" should read --compensation--. Column 9, line 26, "48" should read --138--. Column 10, line 42, "decreases" should read --increases--. Column 13, line 10, "circuit" should read --capacitor--; line 11, after "shot" there should be inserted --circuit--.

Signed and Sealed this

*Twenty-second* Day of *January 1980*

[SEAL]

*Attest:*

SIDNEY A. DIAMOND

*Attesting Officer*

*Commissioner of Patents and Trademarks*